United States Patent [19]

Guigan

[11] 4,377,124

[45] Mar. 22, 1983

[54] SAILBOAT WITH AN INCLINABLE KEEL BOARD

[76] Inventor: Franck Guigan, 9, Avenue de Suffren, 75007 Paris, France

[21] Appl. No.: 220,231

[22] Filed: Dec. 16, 1980

Related U.S. Application Data

[63] Continuation of Ser. No. 30,867, Apr. 17, 1979, abandoned.

[30] Foreign Application Priority Data

Apr. 25, 1978 [FR] France ..... 78 12140
Jan. 5, 1979 [FR] France ..... 79 00270

[51] Int. Cl.[3] ..... B63B 3/38; B63B 41/00

[52] U.S. Cl. ..... 114/128; 114/127; 114/132; 114/143

[58] Field of Search ..... 114/126–143, 114/39

[56] References Cited

U.S. PATENT DOCUMENTS

| | | | |
|---|---|---|---|
| 492,022 | 2/1893 | Jessup | 114/126 |
| 558,575 | 4/1896 | Smith | 114/107 |
| 2,997,974 | 8/1961 | Hamlin | 114/142 |
| 3,088,428 | 5/1963 | Matnoni | 114/129 |
| 4,037,279 | 7/1977 | Ziebart | 114/127 |
| 4,044,703 | 8/1977 | Kurtz | 114/143 |
| 4,117,797 | 10/1978 | Kelley | 114/140 |

FOREIGN PATENT DOCUMENTS

| | | | |
|---|---|---|---|
| 663452 | 10/1929 | France | 114/143 |
| 7708116 | 10/1977 | France | 114/140 |

*Primary Examiner*—Trygve M. Blix
*Assistant Examiner*—D. W. Keen
*Attorney, Agent, or Firm*—Sughrue, Mion, Zinn, Macpeak and Seas

[57] ABSTRACT

The invention relates to a sailboat with a keel board that is inclinable sideways. A single keel board is resiliently inclinable due to the effect of the water which rotates it about an axis disposed substantially in the vertical plane of longitudinal symmetry of the boat and inclined with respect to the horizontal, rising towards the bows of the boat, so as to provide hydrodynamic lift of the inclined keel board compatible with a movement of the boat along its longitudinal axis. In the case of a boat with two inclinable keel boards, the axes of inclination can converge towards the bows of the boat.

6 Claims, 9 Drawing Figures

SAILBOAT WITH AN INCLINABLE KEEL BOARD

This is a continuation of application Ser. No. 30,867 filed Apr. 17, 1979, now abandoned.

BACKGROUND OF THE INVENTION

The invention relates to a sailboat with a keel board that is inclinable sideways.

Known similar boats include:

a hull defining a longitudinal direction which extends between a stern portion and a stem portion;

a keel board which includes a blade which projects beneath the hull to reduce sideways movement of the boat;

a boomed mast on the hull, for carrying sail so that the action of the wind on the sail(s), in conjunction with the action of the water on the blade makes the boat move; and means for inclining the keel board to allow the blade to incline sideways due to the thrust of the water by rotating through a limited angle about at least one inclination axis which is substantially parallel to the keel plane and above it, so that the transversal component of the movement of the boat generates an upward lift due to the action of the water on the blade.

Such limited inclination of the blade of the keel board provides, in addition to the usual leeway-resisting force generated by the pressure of the water on the leeward surface of the blade, a hydrodynamic upward lift force which reduces the apparent weight of the boat and hence its submerged volume and its hydrodynamic drag.

In the case of a boat having two keel boards, one disposed to port and the other to starboard, the lift of the leeward keel board may be arranged to be greater than that of the windward keel board to increase the righting couple which opposes the tendency of the boat to heel. Such a disposition is illustrated in FIG. 11 of U.S. Pat. No. 3,179,078 (Popkin).

These known dispositions make it possible to obtain hydrodynamic lift only to the extent to which the boat makes leeway due to the action of the lateral component of the thrust of the wind on the sail, i.e. to which its movement has a sideways component. The direction of the above movement is therefore not the direction which generates the least hydrodynamic drag, i.e. the least resistance to the forward motion of the submerged portion of the hull. This is particularly true when the hull is more or less triangularly shaped, with tapered bows and a flat bottom which is wide at the stern. Indeed, in that case the heel of the boat modifies the form of the submerged portion of the hull so that the axis thereof turns about the stem as the boat heels, i.e. the direction of least resistance turns to windward, thereby increasing the angle between the direction of least resistance and the direction in which the boat is moving.

Further, the figures of published German patent application No. 24 60 479 entitled "An inclinable keel for a pleasure boat" (Burmester) illustrate a keel which is inclinable by rotation about an axis of inclination in a vertical longitudinal plane of the boat and inclined with respect to the horizontal rising towards the stern. Such a disposition is complex and does not make it possible to remedy the aforementioned drawback if the blade of the keel board is to provide lift.

SUMMARY OF THE INVENTION

The present invention aims to produce a sailboat with an inclinable keel board which makes it possible simultaneously to provide vertical lift from the blade and to have a small difference in angle between the direction of movement of the boat and the direction of least hydrodynamic drag.

It provides a sailboat with an inclinable keel board, said sailing boat including:

a hull defining a longitudinal direction which extends between a stern portion and a stem portion;

a keel board which includes a blade which projects beneath the hull to reduce sideways movement of the boat;

a boomed mast on the hull, for carrying sail so that the action of the wind on the sail(s), in conjunction with the action of the water on the blade makes the boat move; and means for inclining the keel board to allow the blade to incline sideways due to the thrust of the water by rotating through a limited angle about at least one inclination axis which is substantially parallel to the keel plane and above it, so that the transversal component of the movement of the boat generates an upward lift due to the action of the water on the blade, characterized in that said inclination means set the axis of inclination of the keel board in such a manner that as the blade rotates about the axis the axial direction of horizontal cross-sections through the blade are inclined to the said longitudinal direction of the boat at an angle such that the forward end of said axial direction moves, with respect to the said longitudinal direction, in the same direction as the bottom end of the blade moves with respect to its top end, whereby the longitudinal component of the movement of the boat generates an upward lift component from the blade and whereby the direction of movement of the boat is close to the direction of least resistance to the forward movement of the hull.

BRIEF DESCRIPTION OF THE DRAWINGS

Embodiments of the invention will be described hereinafter by way of non-limiting example, with reference to the accompanying drawings. It must be understood that without going beyond the scope of the invention, the components described and illustrated can be replaced by other components which perform the same technical functions. When the same component is illustrated in several figures, it is designated therein by the same reference symbol.

DESCRIPTION OF THE PREFERRED EMBODIMENTS

Figure 1:
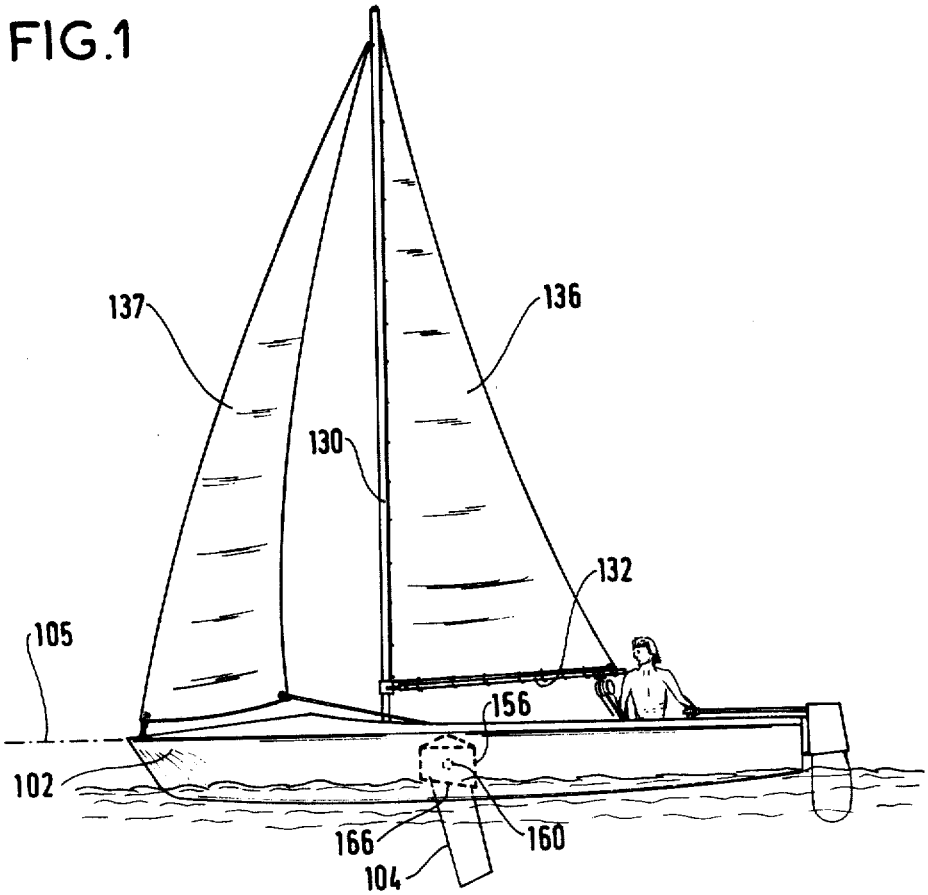
FIG. 1 is a side view of a boat in accordance with a first embodiment of the invention.
Figure 2:
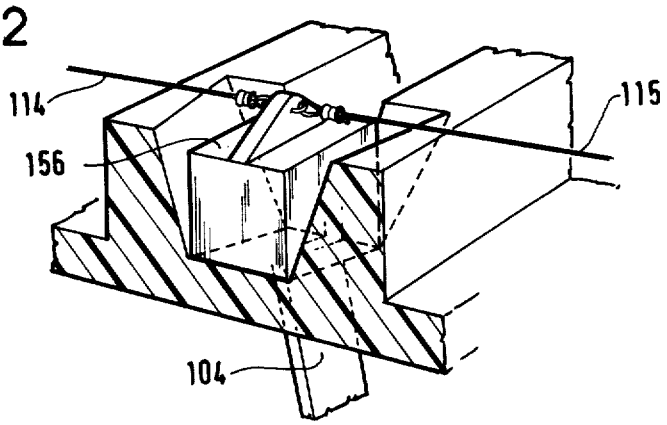
FIG. 2 is a perspective view of the means for inclining the keel board of the boat illustrated in FIG. 1.
Figure 3:
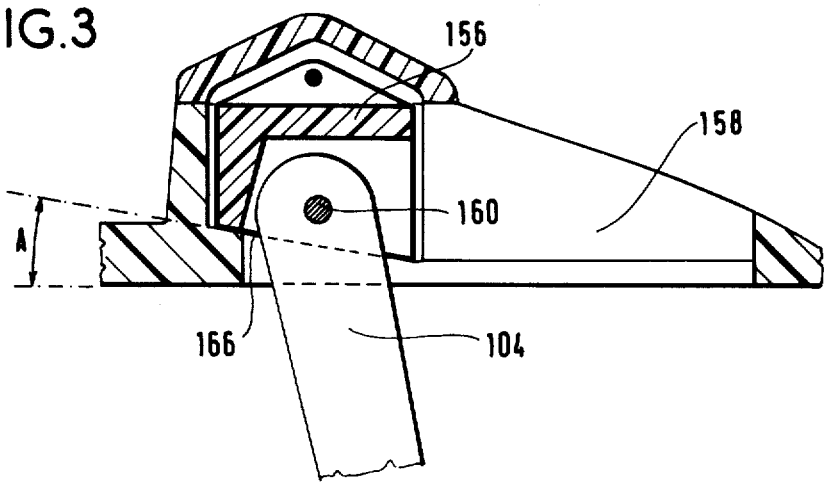
FIG. 3 is a cutaway view of the means illustrated in FIG. 2, in the vertical plane of symmetry of the boat.
Figure 4:
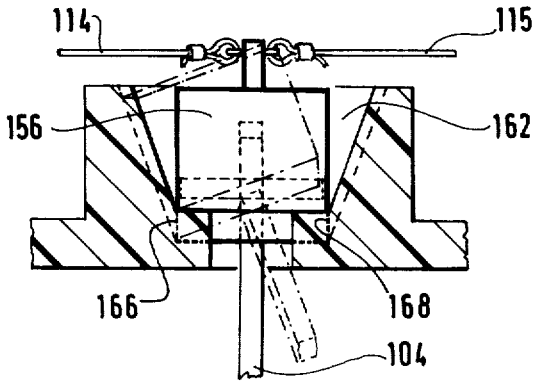
FIG. 4 is a view of the means illustrated in FIG. 3 in a vertical plane perpendicular to that in FIG. 3.
Figure 5:
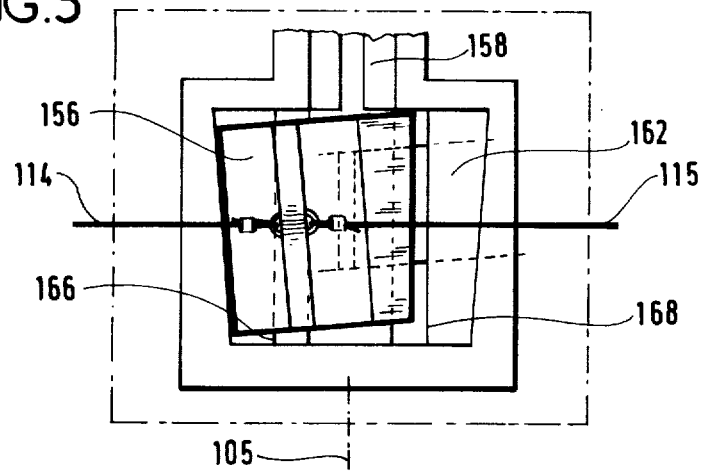
FIG. 5 is a plan of the means illustrated in the above figures.

The boat according to the first embodiment of the invention is a light sailing dinghy with a hull 102 whose horizontal longitudinal axis 105 is situated in the plane of symmetry of the hull in which there is a centre board 104 which can be raised by rotation about a transversal pivot pin 160.

In its normal position, the centre board projects below the hull and the projecting portion is referred to as the blade of the centre board.

The hull has a mast 130 which supports a jib 137, and which, together with a boom 132, also supports a mainsail 136.

It is known that when sailing close to the wind, the transversal component of the thrust exerted by the wind on the sail tends to move the boat sideways and would prevent it from sailing up-wind if an equal and opposite resistance to the sideways movement were not applied to the centerboard to cause the longitudinal direction to become the preferred direction of movement.

It is known to use the lateral force to which the centerboard is subjected to incline the centreboard towards the windward side and therefore under the effect off the residual leeway of the dinghy to lift the hull of the water as a result of the reaction of the water on the centerboard.

The known means used for this purpose is to articulate the centerboard about an axis whose direction is horizontal and which is situated in the vertical longitudinal plane of symmetry of the boat (or on two horizontal parallel axes which are symmetrical with respect to the latter plane for a boat having two keel boards instead of one centerboard. Such an articulation naturally allows the articulated board to assume an inclination towards the windward side, i.e. the lower end of the board then moves towards the windward side of the boat.

The axis of inclination of the board is referenced 166 in FIG. 1. In accordance with the invention, the axis rises towards the front of the boat, whose forward speed increases the extra hydrodynamic lift when the board is inclined and the leeway of the boat is thereby reduced.

The angle A of the axis with respect to the horizontal preferably lies between 1° and 60°. The angle of inclination of the board with respect to the vertical longitudinal plane of symmetry of the boat may be 45° for example. These angles are chosen so that when the board is inclined as far as possible it intersects a horizontal plane at an angle B with the longitudinal axis of the boat which lies between 1° and 9°, e.g. 3° for a racing boat and 6° for a pleasure boat.

FIGS. 2 to 5 illustrate more precisely the means for inclining the board in accordance with the first embodiment of the invention, which include an upside down U-shaped stirrup piece 156 inside which the centre board 104 pivots on the horizontal transverse pin 160 so that it can be lifted into the rear portion of a centerboard trunk 158. The assembly formed by the centerboard and the stirrup piece 156 is then inclined by tilting about an axis such as 166.

The assembly is rotated very simply by pressing the lower ends of the arms of the stirrup piece on the bottom of a recess 162 formed by a widened portion at the front of the trunk 158. The assembly formed by the stirrup piece and by the recess then constitutes the previously mentioned means for inclining the centerboard, the bottom of the recess being sufficiently narrow to prevent transversal movement of the lower portion of the stirrup piece, the upper portions of the recess while are sufficiently wide to allow the stirrup piece to be inclined when it pivots with the centerboard.

The bottom of the recess 162 has two straight lower side edges 166 and 168 which rise towards the bows of the boat. Each of these edges constitutes the line of intersection of two planes. The bottom of the stirrup piece 156 also has two straight lower edges which are received respectives against the edges 166 and 168. The dihedral angles about each edge of the respective pairs of edges are such that the stirrup piece is free to rotate through a fairly small angle (say 45°) about the said pairs of edges.

Resilient rubber extensible spring cords 114 and 115 are each attached firstly to the hull and secondly to the upper portion of the stirrup piece 156, the upper portion of the stirrup piece constituting the base of the U which the stirrup piece would form if it were turned upside down.

They constitute resilient return means from the inclined position which tend to bring the centerboard back into the plane of longitudinal symmetry of the boat. However, other inclination means and resilient return means could be used, e.g. a block of elastomer material which forms the connection between the stirrup piece 156 and the hull.

In accordance with a second embodiment of the invention, e.g. for a narrow boat such as a sail surf board whose optimum angle B is about 3° or 4°, or for boats whose submerged hull axis turns when it heels, an articulated centerboard, in two parts can be installed in a conventional centerboard trunk.

Figure 7:
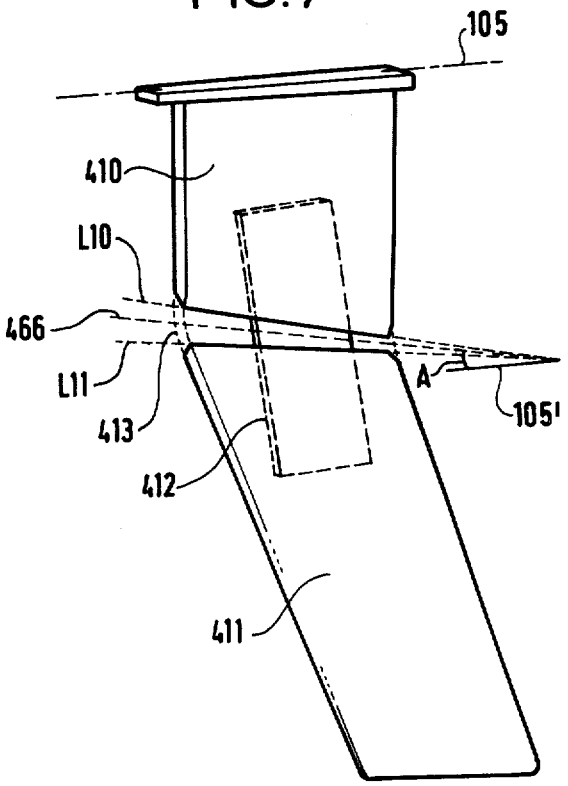
FIG. 7 is a side view of a keel board in accordance with a second embodiment of the invention.

FIG. 7 shows such a centerboard which is constituted by two components: firstly, a fixed head 410 which extends slightly below the bottom of the hull and secondly a moving blade 411 connected to the fixed head and providing the centerboard function as such. These components are connected by a resilient connection which may be constituted by a leaf spring 412 which engages in both the components. The spring is, for example, rectangular and made of steel. It is thinner (1.5 mm, for example, with a width of 10 cm for a sail surf board) than the components which it connects together (wood 19 mm thick, for example), the gap which remains between the components 410 and 411 being filled in by a resilient part 413 which is designed only to prevent turbulence from being formed.

The gap may be wider at the front with a view to increasing the lateral movement of the front of the blade when it is inclined.

The angle A is then that at which the straight line of intersection 466 of the inclined blade is inclined with respect to the horizontal illustrated by a line 105' parallel to the axis 105 of the boat and that of the head of the center board.

Whatever type of centerboard is chosen, it may be an advantage to select the angle A in such a way that the angle B is equal to or slightly greater than the angle of drift of the boat when it sails close to the wind (the angle of drift being measured in a horizontal section through the blade so that the boat moves upwind along its longitudinal axis, if the longitudinal axis is the angle at which its drag is designed to be the lowest.

Figure 6:
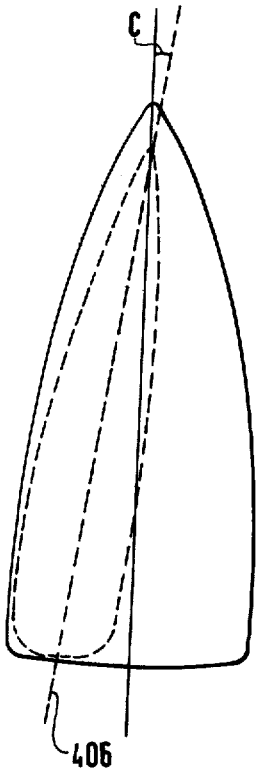
FIG. 6 illustrates the bottom of a boat's hull.

FIG. 6 is a plan of a hull, with the water line of the heeling hull shown in dashed lines. The hull tapers towards the bows and its bottom is flat at the stern so that the line of least hydrodynamic drag turns to windward when the boat heels. The figure shows that the axis of the submerged portion delimited by the water line forms an angle C with the axis of longitudinal symmetry of the boat. It is an advantage, if the boat is to be able to sail fast when heeling to select the angle A so that the angle B is equal or almost equal to the angle of drift of the boat when sailing close to the wind plus the angle C which is formed by the longitudinal axis of the boat and the centre line of the submerged portion 406 of its hull when it has reached approximately the maximum heel at which the submerged portion of its hull allows it to sail fast, so that the boat moves along its new submerged hull axis when heeling to that extent. The direction of movement is indeed that for which the drag is designed to be the lowest when the boat heels at this angle.

Figure 8:
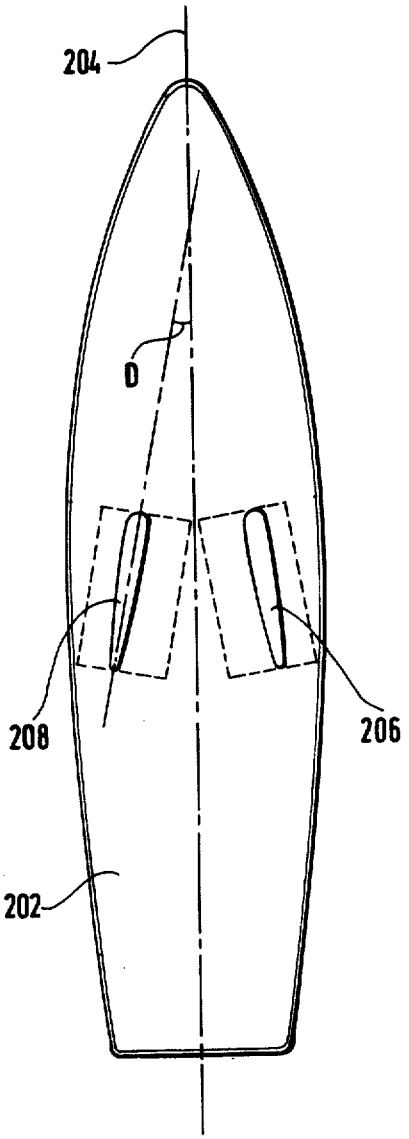
FIGS. 8 and 9 illustrate the bottom of a boat's hull in accordance with a third and a fourth embodiment of the invention.

In the case where two inclinable keelboards 206 and 208 are provided on either side of the plane of vertical longitudinal symmetry of the boat, i.e. a port keel board and a starboard keel board, the angular difference B between the horizontal cross-sections of each blade and the longitudinal axis of the boat and the upward lift may be obtained, in accordance with the invention, not only by raising the axis of inclination towards the bows in a vertical plane, at an angle A with respect to the horizontal, but also by inclining the vertical plane of the axis of inclination at an angle D with respect to the vertical plane of the longitudinal axis of the boat. The vertical planes of the axes of inclination of the two keel boards can then converge towards the front of the boat (FIG. 8). If both axes of inclination are horizontal (A=0), the angle B remains equal to the angle D whatever the inclination of the keel board may be. If the angle A is non-zero, the angle D constitutes the value of the angle B when the keel board is vertical.

It is advisable, so as to balance the heeling couple due to the wind, for the upward lift of the leeward keel board to be as large as possible and for that of the windward keel board to be much smaller or even zero, at least when the boat sails close to the wind.

This balance can be provided either by the simple fact that the boat heels and therefore lifts the windward keel board partially out of the water, or by disposing stop means to limit the deflection of each keel board in such a way that only the leeward keel board is in the water and that the windward keel board floats at the surface. It can even be lifted out of the water by a suitable lifting device. But these means for reducing the lift of the windward keel board have the disadvantage of requiring either a wide beam and a large angle of heel to be effective, or arranging for the windward keel board to project sideways or upwards with respect to the hull, but this is not convenient. The following arrangement can also be adopted:

The angle (D) of the vertical longitudinal plane 204 of the boat and of the vertical plane of inclination of each keel board is substantially equal to the angle between the direction in which the boat sails and the longitudinal axis of the boat sailing close to the wind, righting means 412 being provided to prevent the inclination of each blade when the water applies no thrust perpendicular to it, so that the windward keel board is substantially parallel to the direction in which the boat sails and that the lift is generated mainly by the leeward keel board. FIG. 8 illustrates the preceding disposition, assuming that A=0 and with an angle D between the longitudinal plane 204 of the hull 202 and the directions of the port keel board 206 and starboard keel board 208 of which a plan is shown.

Unfortunately, the above solution does not allow the two keel boards to be aligned with the longitudinal axis of the boat when sailing before the wind if the angle A is zero. That is why, in the case where two lateral keel boards are used, a preferred solution consists in making the two axes of inclination rise towards the bows (angle A positive) and in limiting the inclination of these two keel boards more in the outward direction than in the inward direction. The maximum angle of inclination towards the inside, e.g. 45°, is such, in the above-mentioned conditions, as to enable the leeward keel board to provide both upward lift and lateral thrust which oblige the boat to sail in its direction of least resistance to forward movement e.g. in the direction of its longitudinal axis.

The maximum outward angle of inclination is such that when the boat sails along its longitudinal axis, the windward blade is parallel to the above movement of the boat and does not generate any lift. Besides, it then does not provide any lateral thrust and can possibly be raised into its trunk so as to reduce the resistance to forward movement due to the friction of the blade in the water. Of course, if the direction of least resistance to forward movement of a boat which heels when sailing close to the wind turns windward, with respect to the longitudinal axis, the maximum angle of outward inclination is such that a horizontal cross-section of the windward blade is parallel to the direction of least resistance. Such an inclination which is limited to different extents inwards and outwards can be limited easily for each side keel board with means for counterbalancing the inclination analogous to the means 114 and 115 described with reference to the single centerboard of the first embodiment. To do this, it is necessary only, for example, to replace one of the resilient cords by a non-resilient cord or to double up a resilient cord with a non-resilient cord of appropriate length.

Figure 9:
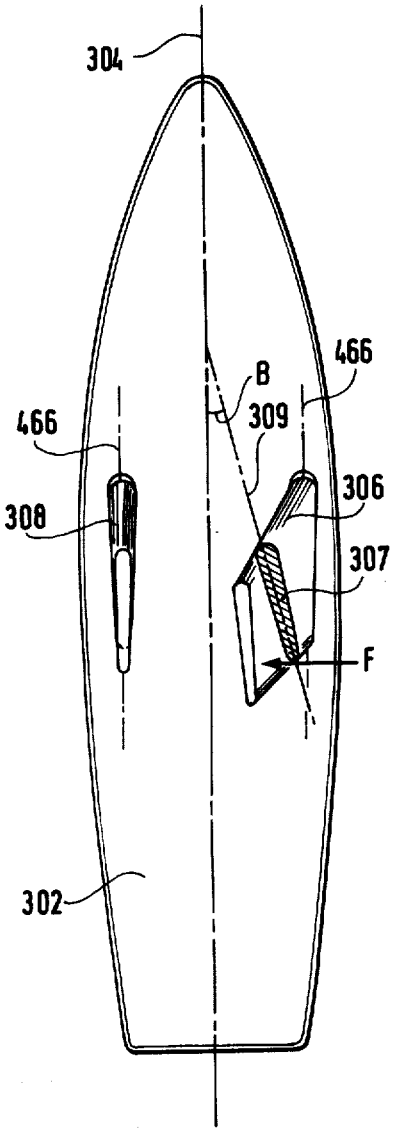

In FIG. 9, which illustrates the above solution, the port and starboard blades are shown vertical at 306 and 308, on either side of a vertical axial plane 304 of the hull. The blade 308 is assumed to be vertical and the blade 306 is assumed to be inclined due to the thrust of the water represented by the arrow F. The end inclined positions of the two keel boards are firstly the vertical position (outward limit) and secondly an inclined position. It is assumed that D=0. The angle B appears as that between the plane 304 and the axis 309 a horizontal cross-section 307 through the inclined blade 306.

Of course, when, for example, two side keel boards are used, it is advantageous for each of them to have, in a known way, an asymmetrical profile which provides an improved ratio between the lift and the drag.

The two keel boards can also be ballasted so that the ballast constitutes a means for counterbalancing the inclination of the blade.

I claim:

1. A sailboat with at least one inclinable keel board, said sailboat including:

a hull defining a longitudinal direction which extends between a stern portion and a stem portion;

a keel board which includes a blade which projects beneath the hull to reduce sideways movement of the boat;

a boomed mast on the hull, for carrying sail so that the action of the wind on the sail(s), in conjunction with the action of the water on the blade makes the boat move; and means for inclining the keel board to allow the blade to incline sideways due to the thrust of the water by rotating through a limited angle about at least one inclination axis which is substantially parallel to the keel blade and above it, so that the transversal component of the movement of the boat generates an upward lift due to the action of the water on the blade, characterized in that wherein the inclining means includes means to set the axis of inclination of the keel board in such a manner that as the blade rotates about the axis, the axial direction of horizontal cross-sections through the blade are inclined to said longitudinal direction of the boat at an angle such that the forward end of said axial direction moves, with respect to said longitudinal direction, in the same direction as the bottom end of the blade moves with respect to its top end, whereby the longitudinal component of the movement of the boat generates an upward lift component from the blade and whereby the direction of movement of the boat is close to the direction of least resistance to the forward movement of the hull, and wherein said inclining means is such that the inclination axis of the blade is disposed in a vertical longitudinal plane of the boat and is inclined with respect to the horizontal rising towards the bow of the boat so that the axial direction of horizontal cross-sections through the blade are inclined with respect to the longitudinal direction only when the blade is inclined outside the vertical plane of the inclination axis, and wherein inclination of the blade is directly caused by the pressure of the water and is around an inclination axis extending substantially above the blade.

2. A boat according to claim 1, wherein said inclining means is such that the angle (A) of the axis of inclination of the keel board with respect to the horizontal and the maximum angle of rotation of the blade on said axis are such that when the keel plane is inclined as far as possible to windward, the axial direction of horizontal cross-sections through the blade form an angle (B) which lies between 1° and 9° with the direction of least resistance to forward motion of the hull.

3. A boat according to claim 1, wherein the keel board includes a fixed center head, the blade being disposed beneath the head and connected thereto by said inclining means, and wherein said inclining means are constituted by a resilient connection which extends along the upper edge of the blade.

4. A boat according to claim 3, wherein said inclining means are constituted by a leaf spring which engages firstly in the board head and secondly in the blade and is thinner than the board head, the gap between the blade and the board head being filled in by a deformable component which prevents turbulence.

5. A boat according to claim 1, wherein said at least one inclinable keel board includes a port keel board and a starboard keel board disposed on either side of a vertical axial plane through the hull, each of the keel boards being provided with said inclining means, characterized in that the vertical planes of the inclination axes of said two keel boards converge towards the bows of the boat so that the axial direction of horizontal cross-sections through the blade are inclined with respect to the longitudinal direction.

6. A boat according to claim 1, wherein said inclining means include resilient means for counterbalancing the inclination of the keel board in a vertical plane.

* * * * *